US010750890B2

(12) United States Patent
Xu et al.

(10) Patent No.: US 10,750,890 B2
(45) Date of Patent: Aug. 25, 2020

(54) SPILL-PROOF CUP

(71) Applicants: THE JOHNS HOPKINS UNIVERSITY, Baltimore, MD (US); KENNEDY KRIEGER INSTITUTE, INC., Baltimore, MD (US)

(72) Inventors: Yu Xu, Baltimore, MD (US); Nathaniel J. Leon, Baltimore, MD (US); Tara Johnson, Baltimore, MD (US); Alexander De La Vega, Baltimore, MD (US)

(73) Assignees: The Johns Hopkins University, Baltimore, MD (US); Kennedy Krieger Institute, Inc., Baltimore, MD (US)

( * ) Notice: Subject to any disclaimer, the term of this patent is extended or adjusted under 35 U.S.C. 154(b) by 38 days.

(21) Appl. No.: 15/577,831

(22) PCT Filed: May 31, 2016

(86) PCT No.: PCT/US2016/034941

§ 371 (c)(1),
(2) Date: Nov. 29, 2017

(87) PCT Pub. No.: WO2016/196422

PCT Pub. Date: Dec. 8, 2016

(65) Prior Publication Data

US 2018/0160829 A1 Jun. 14, 2018

Related U.S. Application Data

(60) Provisional application No. 62/168,159, filed on May 29, 2015.

(51) Int. Cl.
*A47G 19/22* (2006.01)

(52) U.S. Cl.
CPC ..... *A47G 19/2272* (2013.01); *A47G 19/2205* (2013.01)

(58) Field of Classification Search
CPC ..... A47G 19/2272; A47G 19/2266; A47G 19/2222; B65D 2547/066; B65D 47/06;
(Continued)

(56) References Cited

U.S. PATENT DOCUMENTS 3,618,558 A * 11/1971 Tepfer ..... G01K 11/08 116/216
8,186,537 B2 5/2012 Rosnak et al.
(Continued)

FOREIGN PATENT DOCUMENTS

JP 2014-061064 A 4/2014

*Primary Examiner* — Shawn M Braden
(74) *Attorney, Agent, or Firm* — Johns Hopkins Technology Ventures

(57) ABSTRACT

An embodiment in accordance with the present invention is directed to a spill-proof cup. The cup includes an innovative mechanisms to allow for a completely spill-proof and ergonomic cup. The cup functions in the same manner as a regular cup. In some embodiments the spill-proof feature of the cup is facilitated by a weight that will fall down when the cup is tilted. In other embodiments, chambers are filled with liquid to control flow and only allow the user a volume of one sip of liquid at a time. As a result of these specialized embodiments, the cup does not consume electricity, is safe to use, and costs little both to make and to purchase.

15 Claims, 9 Drawing Sheets

(58) Field of Classification Search
CPC ..... B65D 51/1672; B65D 81/3841; B65D 2543/00046
USPC ..... 220/719
See application file for complete search history.

(56) References Cited

U.S. PATENT DOCUMENTS

| | | | | |
|---|---|---|---|---|
| 2005/0230404 | A1 | 10/2005 | Dark | |
| 2006/0201902 | A1 | 9/2006 | Brown et al. | |
| 2012/0261375 | A1* | 10/2012 | Loging | A47G 19/2272 215/11.4 |
| 2013/0240545 | A1 | 9/2013 | O'Sullivan | |
| 2014/0069885 | A1* | 3/2014 | Paxson | A47G 19/2272 215/11.4 |
| 2015/0076050 | A1* | 3/2015 | May | B01D 35/02 210/232 |
| 2017/0112306 | A1* | 4/2017 | Muir, III | B65D 43/0212 |

* cited by examiner

SPILL-PROOF CUP

CROSS-REFERENCE TO RELATED APPLICATIONS

This application is a 35 U.S.C. § 371 U.S. national entry of International Application PCT/US2016/034941, having an international filing date of May 31, 2016, which claims the benefit of U.S. Provisional Application No. 62/168,159, filed May 29, 2015, the content of each of the aforementioned applications is herein incorporated by reference in their entirety.

FIELD OF THE INVENTION

The present invention relates generally to drinking vessels. More particularly, the present invention relates to a spill-proof cup.

BACKGROUND OF THE INVENTION

Persons with physical disabilities often find difficulty in daily tasks such as eating and drinking. Neurological conditions, such as cerebral palsy, Parkinson's disease, multiple sclerosis, stroke, and other conditions can cause hand tremors or weak grasp and therefore make an affected person likely to spill food and beverages. Spill-proof cups are one way to make the daily task of drinking much easier.

Spill-proof cups, such as "sippy-cups" for young children or travel mugs for transporting hot beverages or other drinks in the car or on the go, are already available on the market. However, not all of these cups are suitable for use by persons with disabilities, for a number of reasons. Adding a lid to a cup does not automatically make it spill-proof, and supposedly "spill-proof" cups do spill or at least leak if the lid isn't screwed on tightly or the cover over the drinking area is not properly secured.

Accordingly, it would therefore be beneficial to provide a design for a cup that is completely spill-proof and easy to use.

SUMMARY OF THE INVENTION

The foregoing needs are met, to a great extent, by the present invention which provides a device for drinking including a cup base defining an interior space configured for holding a liquid. The device includes a lid defining an opening through which the liquid can be dispensed to the user. The lid also defines a hole positioned such that a user's lip seals the hole when the device is positioned for drinking. Additionally, the lid defines a space in the underside of the lid. the lid is configured to be coupled to the cup base. The device includes an occluder for the opening. The device also includes a mechanism disposed in the space in the underside of the lid. The mechanism includes a weight that compresses a first piston when the cup is tilted for drinking. The mechanism includes a second piston that engages a lever for moving the occluder, such that liquid can flow through the opening to the user. The mechanism also includes tubing, such that when the user's lip occludes the hole airflow is prevented in the tubing and the first piston can engage the second piston to move the occluder from the opening.

In accordance with an aspect of the present invention, the lever for moving the occluder is actuated by a spring. The cup base is formed from one selected from a group consisting of metal, plastic, and glass. The lid is formed from one selected from a group consisting of metal, plastic, and glass. The mechanism includes a rail along which the weight travels.

In accordance with another aspect of the present invention, a device for drinking includes a storage chamber configured for holding a fluid. The drinking device includes a feeding chamber in fluid communication with the storage chamber. The drinking device also includes a duct in fluid communication with the feeding chamber. The duct is filled with fluid from the feeding chamber, when the device is tilted. A top venting chamber of the drinking device is in one way fluid communication with the storage chamber. The top venting chamber is configured to allow air to flow into a space defined by a housing of the top venting chamber and into the storage chamber.

In accordance with still another aspect of the present invention, a form of the drinking device takes a tapered shape. A gripping surface is disposed on an outer surface of the drinking device. The gripping device is formed from one selected from a group consisting of rubber and silicone. The drinking device includes a stability base. The drinking device also includes a biting valve. Vent holes are defined by the housing of the top venting chamber. The top venting chamber further includes a one way valve. Holes for transferring the fluid from the storage chamber to the feeding chamber are defined by a housing of the feeding chamber. The drinking device also includes a handle. The handle includes a two-grip handle or a one grip handle. The choice of handle depends on the capabilities of the user. The drinking device further includes a gripping base. The gripping base is formed from one of rubber and silicone. The feeding chamber is configured to refill when the drinking device is in an upright position.

BRIEF DESCRIPTION OF THE DRAWINGS

The accompanying drawings provide visual representations, which will be used to more fully describe the representative embodiments disclosed herein and can be used by those skilled in the art to better understand them and their inherent advantages. In these drawings, like reference numerals identify corresponding elements and:

FIG. 5B illustrates a perspective view of vent holes, according to an embodiment of the present invention.

FIG. 5C illustrates a perspective view of a one way valve, according to an embodiment of the present invention.

FIG. 5D illustrates a perspective, exploded view of a stability base and lower feeding chamber, according to an embodiment of the present invention.

DETAILED DESCRIPTION

Figure 1A:
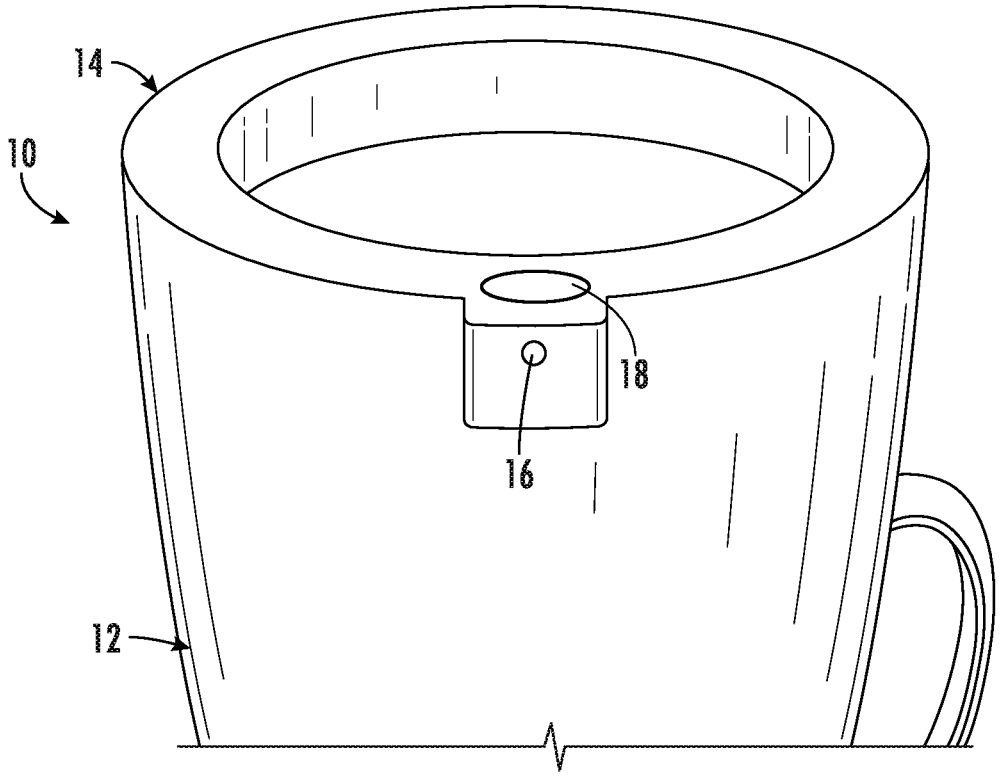
FIG. 1A illustrates a perspective view image of a spill-proof cup, according to an embodiment of the present invention.

The presently disclosed subject matter now will be described more fully hereinafter with reference to the accompanying Drawings, in which some, but not all embodiments of the inventions are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

An embodiment in accordance with the present invention is directed to a spill-proof cup. The cup includes an innovative mechanism to allow for a completely spill-proof and ergonomic cup. The cup has a hole on the edge of the top, and is located beneath the plug or opening. The plug automatically opens when the hole is sealed by the person's lower lip, and the cup is tilted, both of which happen naturally while drinking. Therefore, the cup functions in the same manner as a regular cup. The spill-proof feature of the cup is facilitated by a weight that will fall down when the cup is tilted. As a result, the cup does not consume electricity, it is safe to use, and costs little both to make and to purchase.

The cup of the present invention is completely spill-proof. The plug will only open when the person is trying to drink (when the hole is sealed, and the cup is tilted), not when the cup is tipped accidentally. During drinking, if the lip loses contact with the cup, and the hole is left uncovered (the time when liquid is would leak out), the plug will close automatically.

Generally, the design includes two pistons connected by a tube: one piston attaches to a weight, which will fall down when the person is drinking and the cup is tilted. When the piston is compressed by the weight, air flows through the tubing network, activates the other piston, and opens the plug, or opening. The cup has a hole on the edge of the top that connects to the tubing network, and is located beneath the plug; this system will only work when the hole is sealed. If the hole is not covered by the lip, the first piston won't be able to push the second one (as air leaks out), and the plug will be closed. The rail of the weight is placed at an angle. When the cup is put back, the weight slides back due to gravity, and the cup is ready for the next drink. When the person is going to drink, he or she places the cup on their lower lip, and the hole should be sealed automatically. When the cup is tilted, the weight falls down and pushes the piston; the plug then opens.

FIG. 1A illustrates a perspective view image of a spill-proof cup, according to an embodiment of the present invention. The cup 10 includes a base 12, in which the beverage or liquid can be contained. Lid 14 is disposed on a top lip of the base 12. The lid 14 and the base 12 can be coupled in any way known to or conceivable by one of skill in the art, such as by threading the lid and cup lip, friction, a rubber washer seal, etc. The lid 14 includes a hole 16 disposed just below the opening 18, both defined by the lid 14. The liquid is dispensed from the cup 10 into the user's mouth through opening 18. When the user brings the cup 10 to the lips to drink the bottom lip seals hole 16. The cup base 12 and lid 14 can be formed from any suitable material known to or conceivable by one of skill in the art, including, glass, plastic, metal, etc.

Figure 1B:
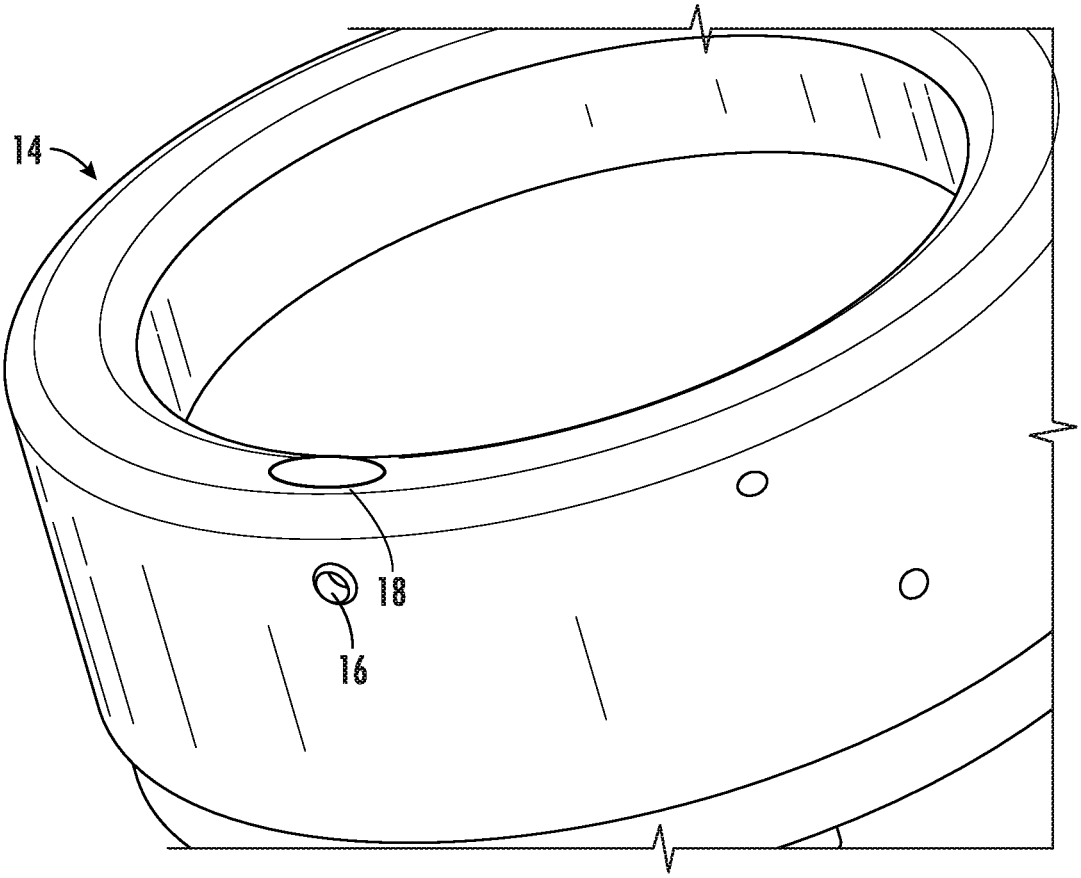
FIG. 1B illustrates a perspective view of a lid of a spill-proof cup, according to an embodiment of the present invention.

FIG. 1B illustrates a perspective view of a lid of a spill-proof cup, according to an embodiment of the present invention. As described above, the lid 14 includes a hole 16 disposed just below the opening 18, both defined by the lid 14. The liquid is dispensed from the cup into the user's mouth through opening 18. When the user brings the cup 10 to the lips to drink the bottom lip seals hole 16.

Figure 2:
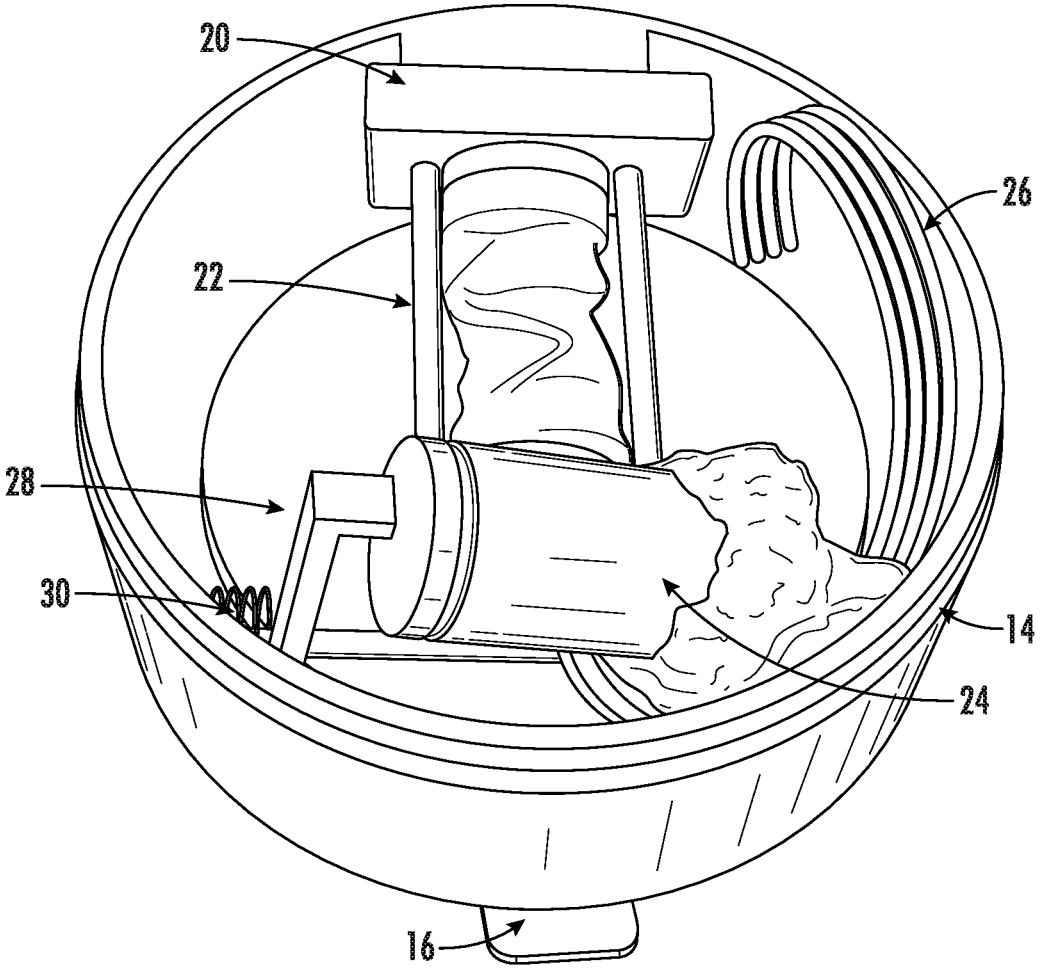
FIG. 2 illustrates an underside view of a lid of a spill-proof cup, according to an embodiment of the present invention.

FIG. 2 illustrates an underside view of a lid of a spill-proof cup, according to an embodiment of the present invention. As illustrated in FIG. 2 the mechanism disposed in the space defined by the underside of the lid 14 includes a weight 20. When the cup is tilted by the user the weight 20 falls back to compress a first piston 22. The user's lip sealing the opening 16 prevents airflow from the tubing network 26 and thereby allows the first piston to compress the second piston 24. The second piston 24 actuates a spring 30 and a lever 28 that open the opening (not pictured here), which is otherwise occluded.

Figure 3:
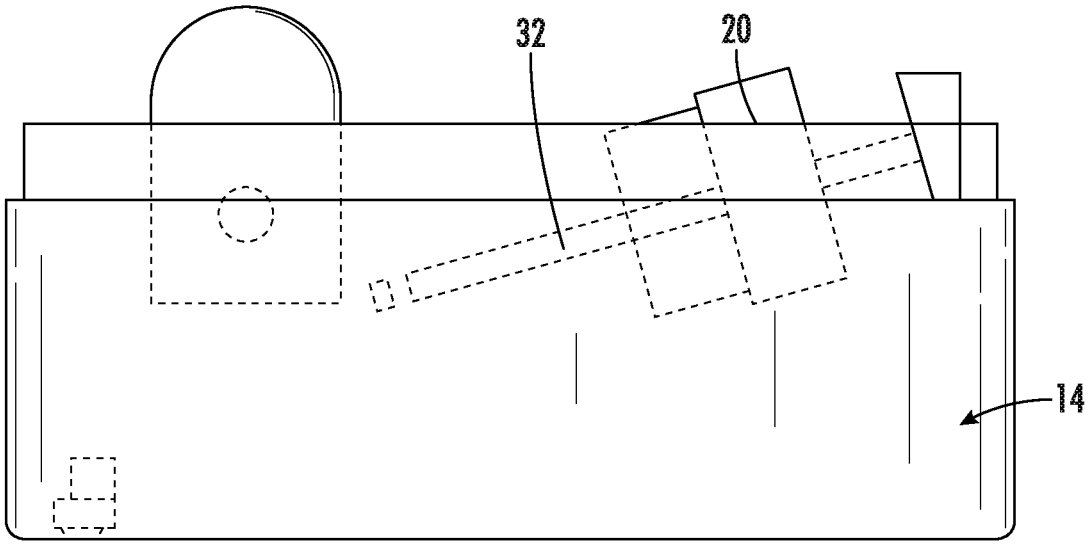
FIG. 3 illustrates a partially sectional side view of the lid of a spill-proof cup, according to an embodiment of the present invention.

FIG. 3 illustrates a partially sectional side view of the lid of a spill-proof cup, according to an embodiment of the present invention. FIG. 3 further illustrates the lid 14 and the weight 20 disposed within the space defined by the underside of the lid 14. The weight 20 is on rail 32. The rail 32 is placed at an angle. When the cup is tilted for drinking the weight 20 falls along the rail 32 to compress the piston. When the cup is not in use and put down gravity moves the weight 20 back down along the rail 32.

Figure 4:
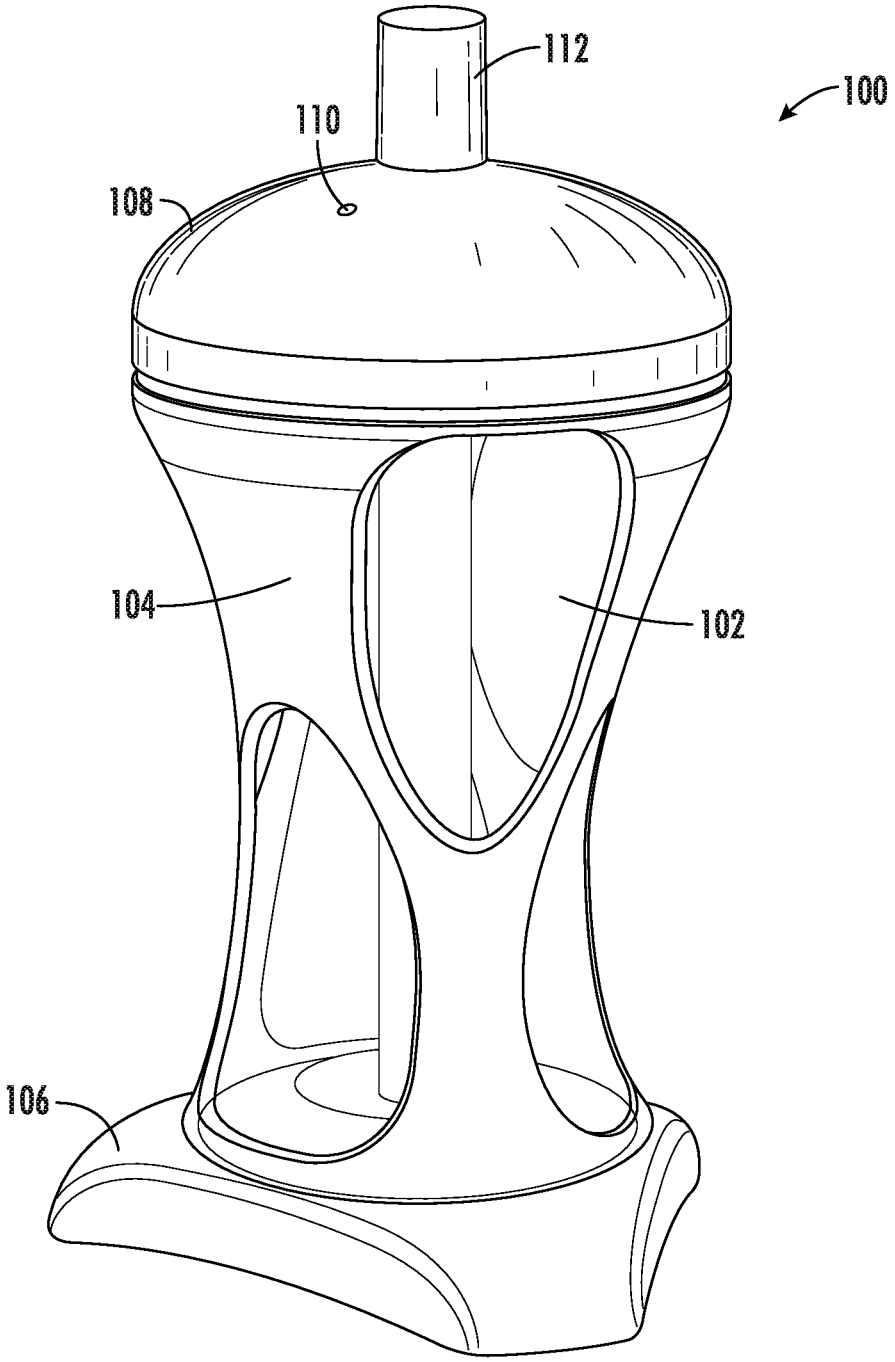
FIG. 4 illustrates a perspective view of a spill-proof cup according to another embodiment of the present invention.
Figure 5A:
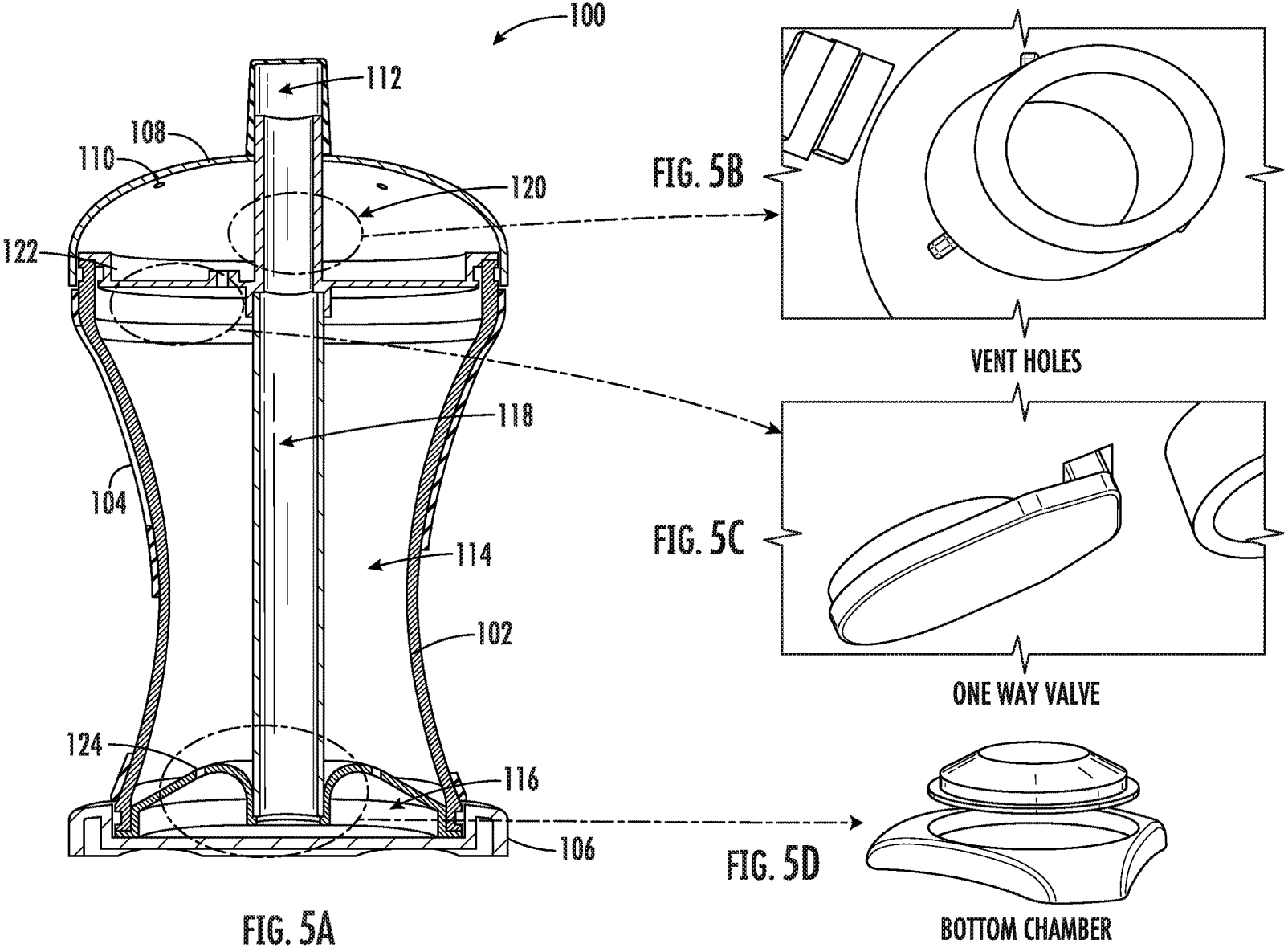
FIG. 5A illustrates a sectional view of the spill-proof cup of FIG. 4, according to another embodiment of the present invention.

FIG. 4 illustrates a perspective view of a spill-proof cup and FIG. 5A illustrates a sectional view of the spill-proof cup of FIG. 4, according to another embodiment of the present invention. The spill-proof cup 100 includes a body 102 for holding the user's beverage of choice. The body 102 includes a grip surface 104 that allows the user to have a secure grip on the spill-proof cup 100 during use. The spill-proof cup 100 also includes a stability base 106. The stability base 106 prevents the spill-proof cup from being knocked over, while it is resting on a surface, such as a table. The spill-proof cup 100 also includes a lid 108. The lid 108 includes vents 110 for allowing smooth outflow of the liquid within, and also a biting valve 112 for allowing flow of the beverage within the spill-proof cup 100 only when the user desires a drink. Any number or size of vents 110 known to or conceivable by one of skill in the art could be used, but in the embodiment shown in FIGS. 4 and 5A three vents are used.

Internally, as illustrated in more detail in FIG. 5A, the spill-proof cup includes a storage chamber 114 that stores liquid to be transferred into feeding chamber 116. The feeding chamber 116 is in fluid communication with duct or straw 118 that defines an interior lumen that delivers the fluid to the user, after the biting valve 112 is engaged. Lid 108 also includes a top venting chamber 120 that encloses vent holes 110 to prevent leakage. The top venting chamber 120 prevents fluid from flowing into the duct 118 when the spill-proof cup 100 is tilted. The top venting chamber 120 is connected to the storage chamber 114 via a one way valve 122. The one way valve 122 allows for air to flow from the vents into the storage chamber 102 and prevents fluid from flowing into the top venting chamber 120.

Further, as illustrated in FIG. 5A, the spill-proof cup 100 of the present invention, includes two main chambers: storage chamber 114 and feeding chamber 116. The two chambers 114 and 116 are connected by four small openings 124. While 4 small openings are disclosed herein, any suitable number and size of openings known to or conceivable to one of skill in the art could also be used. Duct 118 connects the lower feeding chamber 116 directly to the biting valve 112. For each sip, the user can only take a small amount of liquid coming from the lower feeding chamber 116 by tilting the spill-proof cup. When the spill-proof cup 100 is tilted, the liquid inside the lower feeding chamber 116 either enters the duct 118 or flows back to the storage chamber 114 through the four small openings 124. At this time, the duct 118 serves as a reservoir. The user is only able to drink the liquid inside the duct 118 and the volume of the duct 118 controls the volume the user could take per sip.

Figure 6:
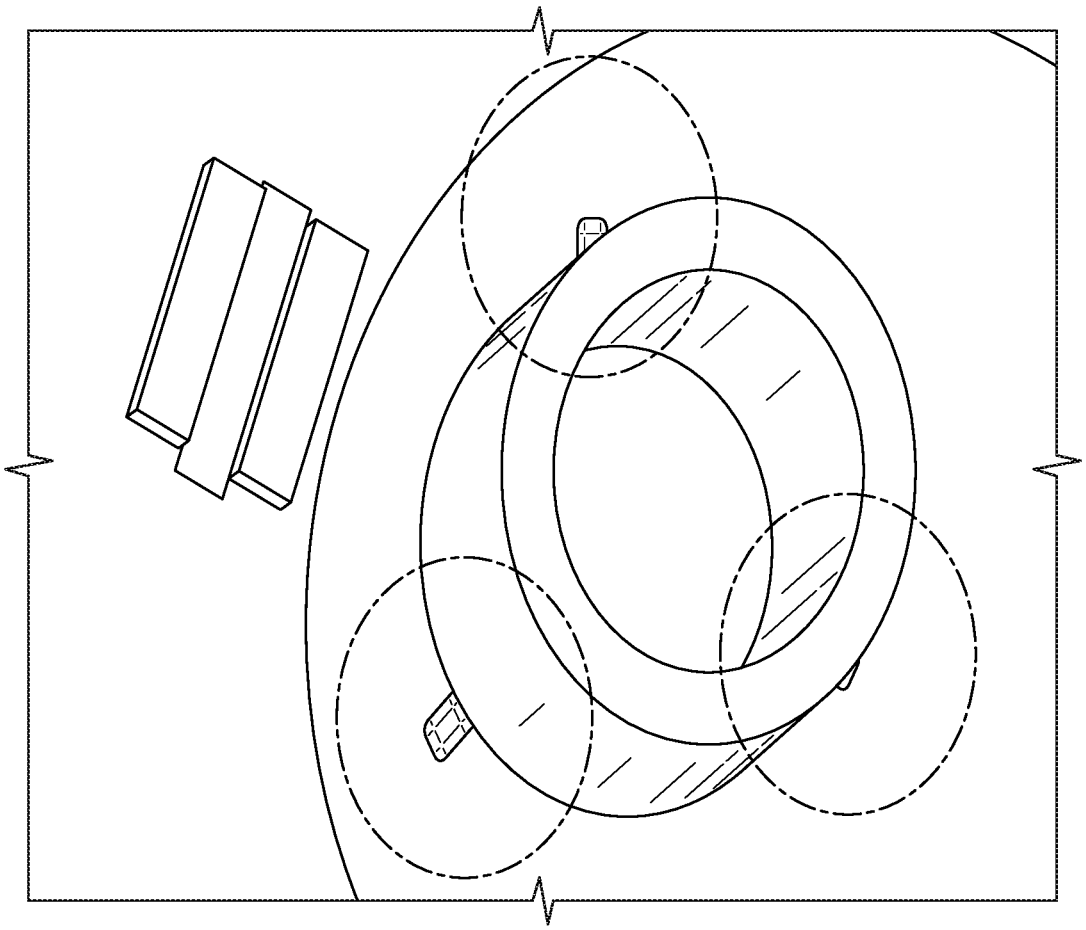
FIG. 6 further illustrates positions of vent holes in the lid, according to an embodiment of the present invention.
Figure 7:
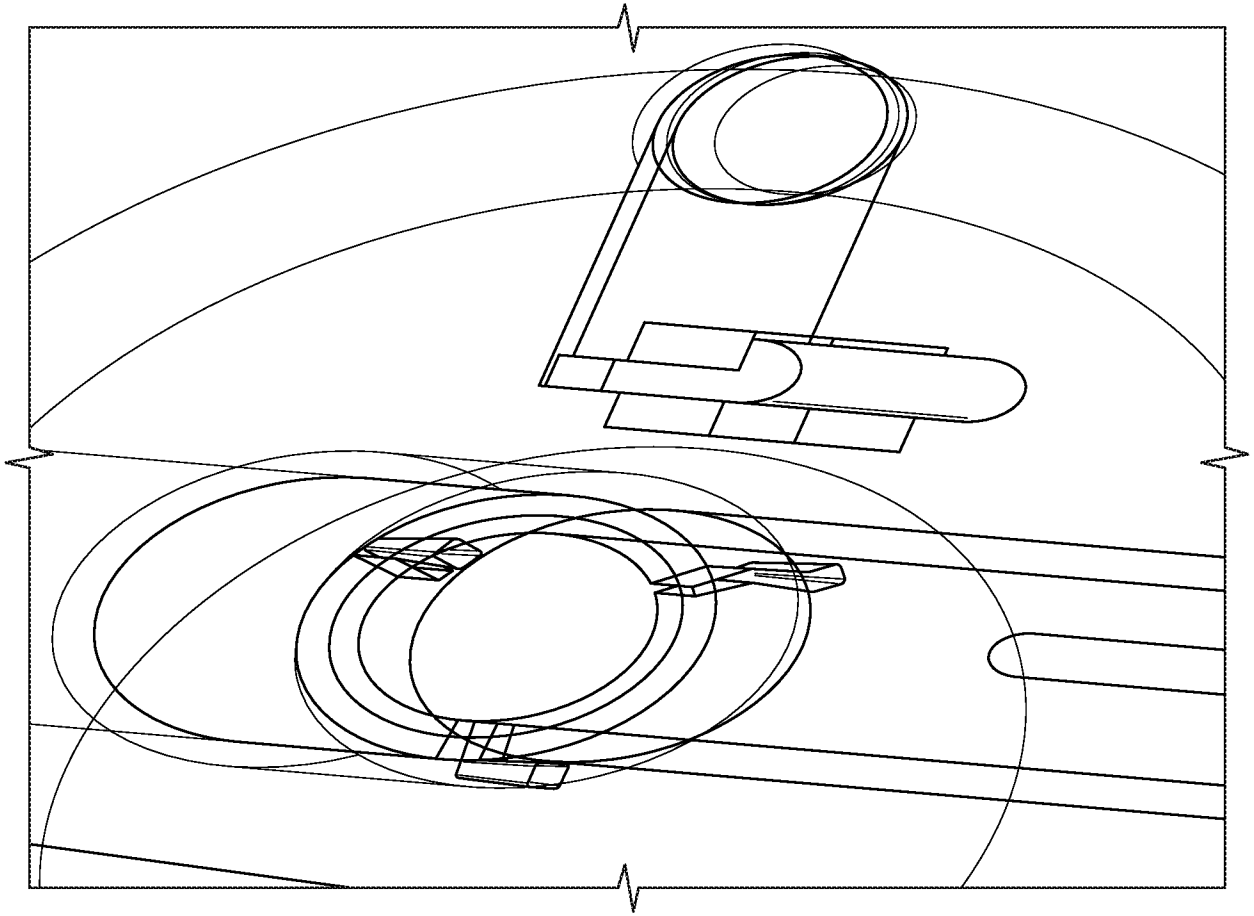
FIG. 7 further illustrates a one way valve, according to an embodiment of the present invention.

When the spill-proof cup 100 is put back to the upright position, the storage chamber 114 refills the lower feeding chamber 116 through the four small openings 124, allowing a subsequent sip. In order for the liquid in the storage chamber 114 to refill the lower feeding chamber 116, a venting mechanism is required to release the air inside the lower feeding chamber. At this point, the duct 118 serves as a vent duct allowing air to flow out of the lower feeding chamber 116 and enter and leave the top-venting chamber 120 on the lid 108 through three vent holes 110. While the venting mechanism is incorporated into the duct 118 in the embodiment shown in FIGS. 4 and 5A, any suitable venting mechanism known to or conceivable by one of skill in the art whether incorporated into the duct or a separate venting mechanism could also be used. FIG. 5B illustrates a perspective view of vent holes, according to an embodiment of the present invention. FIG. 5C illustrates a perspective view of a one way valve, according to an embodiment of the present invention, and FIG. 5D illustrates a perspective, exploded view of a stability base 106 and lower feeding chamber 116, according to an embodiment of the present invention. FIG. 6 further illustrates positions of vent holes in the lid, according to an embodiment of the present invention. FIG. 7 further illustrates a one way valve, according to an embodiment of the present invention. The one way valve allows air to flow into the storage chamber and prevents water from flowing into the top venting chamber.

Many individuals with neurological disorders have gross-motor dysfunctions. Some of them have trouble grasping objects. In addition, some individuals have difficulties coordinating movements of different joints. Often, they are unable to accurately reach a cup on a table. Therefore, a spill-proof cup according to an embodiment of the present invention, such as the one illustrated in FIGS. 4 and 5A has a tapered design to allow for easier grasping. The stability base is enlarged to prevent accidental tipping of the spill-proof cup. The shape of the stability base is configured to prevent rolling on the table. A bottom surface of the spill-proof cup can also be covered with a rubber, a silicone, or other grip enhancing material to prevent unwanted slipping.

Physiological conditions of people with neurological disorders vary along a wide spectrum. Some people might prefer to use handles instead of grasping the cup. Some individuals might prefer to grasp the handle from a specific orientation while some might prefer to hold the cup with both hands. Therefore, the present invention, in some embodiments provides interchangeable handles to accommodate different physiological conditions.

Figure 9:
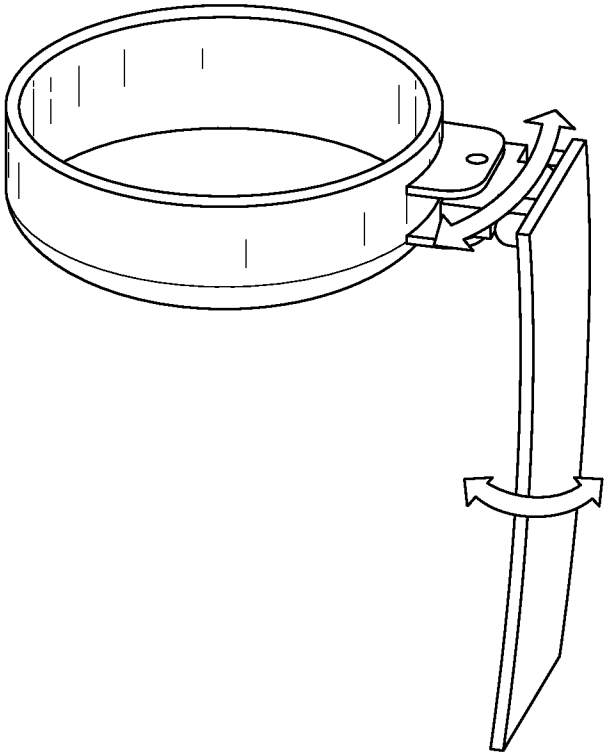
FIG. 9 illustrates a handle design, for a spill-proof cup according to an embodiment of the present invention.
Figure 8:
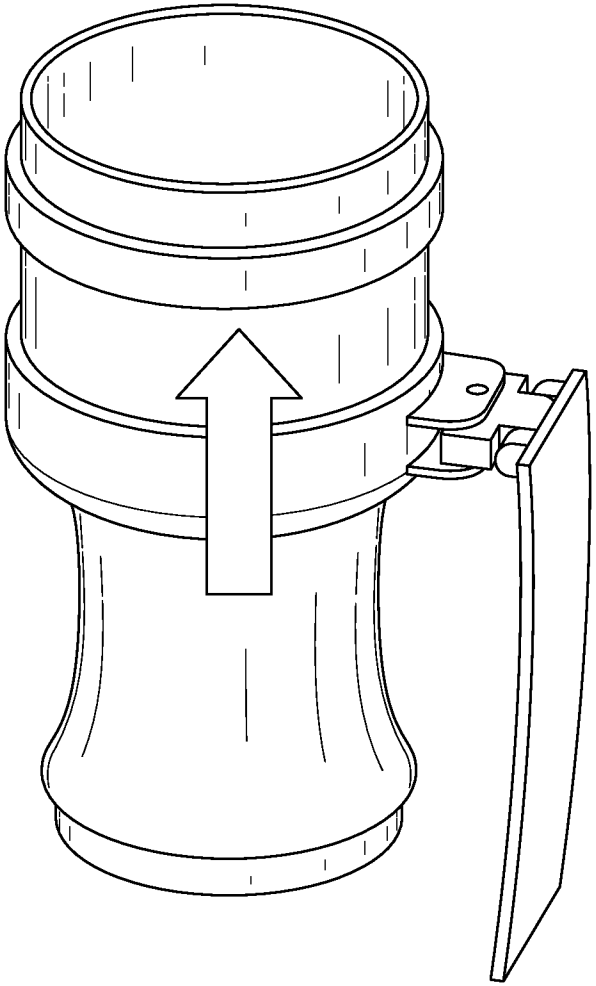
FIG. 8 illustrates a spill-proof cup design with a handle, according to an embodiment of the present invention.

FIG. 8 illustrates a spill-proof cup design with a handle, according to an embodiment of the present invention. FIG. 9 illustrates a handle design, for a spill-proof cup according to an embodiment of the present invention. In order to accommodate a large variety of symptoms, the cup has additional interchangeable handles. The handles are installed easily by sliding onto the cup, as illustrated in FIG. 8. Patients or guardians can choose the best combinations that match their conditions and needs. At least two handle designs are possible. 1) A single handle with two degrees of freedom for adjustment, allowing grasping from different orientations, as illustrated in FIG. 9; 2) Standard double handle allowing stable grasping from both sides. Any other suitable handle design known to or conceivable by one of skill in the art is also included within the scope of the present invention.

The many features and advantages of the invention are apparent from the detailed specification, and thus, it is intended by the appended claims to cover all such features and advantages of the invention, which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A drinking device comprising:

a storage chamber configured for holding a fluid;

a feeding chamber in fluid communication with the storage chamber, such that fluid flows into the feeding chamber from the storage chamber when the drinking device is positioned in an upright position and wherein fluid flows out of the feeding chamber into the storage chamber when the device is tilted;

a duct in fluid communication with the feeding chamber, wherein the duct is filled with an amount of fluid from the feeding chamber, when the device is tilted, such that the only fluid available to drink is the amount of fluid from the feeding chamber that flowed into the duct; and a top venting chamber in one way fluid communication with the storage chamber, wherein the top venting chamber is configured to allow air to flow into a space defined by a housing of the top venting chamber and into the storage chamber.

2. The drinking device of claim 1 further comprising a form of the drinking device taking a tapered shape.

3. The drinking device of claim 1 further comprising a gripping surface disposed on an outer surface of the drinking device.

4. The drinking device of claim 3 further comprising the gripping device being formed from one selected from a group consisting of rubber and silicone.

5. The drinking device of claim 1 further comprising a stability base.

6. The drinking device of claim 1 further comprising a biting valve.

7. The drinking device of claim 1 further comprising vent holes defined by the housing of the top venting chamber.

8. The drinking device of claim 1 wherein the top venting chamber further comprises a one way valve.

9. The drinking device of claim 1 further comprising holes defined by a housing of the feeding chamber.

10. The drinking device of claim 1 further comprising a handle.

11. The drinking device of claim 10 further comprising a two-grip handle.

12. The drinking device of claim 10 further comprising a one-grip handle.

13. The drinking device of claim 1 further comprising a gripping base.

14. The drinking device of claim 13 wherein the gripping base is formed from one selected from a group consisting of rubber and silicone.

15. The drinking device of claim 1 further comprising the feeding chamber being configured to refill when the drinking device is in an upright position.

* * * * *